US009579895B2

(12) United States Patent
Yamashita et al.

(10) Patent No.: US 9,579,895 B2
(45) Date of Patent: Feb. 28, 2017

(54) LIQUID JET HEAD AND LIQUID JET APPARATUS

(71) Applicant: SII PRINTEK INC., Chiba-shi, Chiba (JP)

(72) Inventors: Ryoichiro Yamashita, Chiba (JP); Kazuyoshi Tominaga, Chiba (JP); Yosuke Kami, Chiba (JP)

(73) Assignee: SII PRINTEK INC. (JP)

( * ) Notice: Subject to any disclaimer, the term of this patent is extended or adjusted under 35 U.S.C. 154(b) by 0 days.

(21) Appl. No.: 14/721,453

(22) Filed: May 26, 2015

(65) Prior Publication Data

US 2015/0352842 A1 Dec. 10, 2015

(30) Foreign Application Priority Data

Jun. 4, 2014 (JP) ..... 2014-116012

(51) Int. Cl.
*B41J 2/14* (2006.01)
*B41J 2/16* (2006.01)

(52) U.S. Cl.
CPC ..... *B41J 2/1621* (2013.01); *B41J 2/1433* (2013.01); *B41J 2/14201* (2013.01); *B41J 2/14209* (2013.01); *B41J 2/14314* (2013.01); *B41J 2/1623* (2013.01); *B41J 2002/14362* (2013.01); *B41J 2002/14491* (2013.01)

(58) Field of Classification Search
CPC ..... B41J 2202/11; B41J 2202/13
See application file for complete search history.

(56) References Cited

U.S. PATENT DOCUMENTS

| | | | | |
|---|---|---|---|---|
| 7,658,470 | B1 | 2/2010 | Jones et al. | 347/50 |
| 8,931,886 | B2 * | 1/2015 | Hoshino | B41J 2/14209 347/58 |
| 2005/0062806 | A1 | 3/2005 | Terakura et al. | 347/72 |
| 2007/0206057 | A1 | 9/2007 | Brown et al. | 347/54 |
| 2007/0296763 | A1 * | 12/2007 | Kubo | B41J 2/04541 347/50 |
| 2011/0018922 | A1 * | 1/2011 | Ueda | B41J 2/1623 347/10 |
| 2011/0310161 | A1 | 12/2011 | Kimura et al. | 347/20 |

(Continued)

FOREIGN PATENT DOCUMENTS

| | | |
|---|---|---|
| JP | 2004314608 | 11/2004 |
| JP | 2006281736 | 10/2006 |

(Continued)

OTHER PUBLICATIONS

Intellectual Property Office Search Report issued on Dec. 1, 2015 in Application No. GB 1509721.5.

*Primary Examiner* — Kristal Feggins
*Assistant Examiner* — Kendrick Liu
(74) *Attorney, Agent, or Firm* — Adams & Wilks

(57) ABSTRACT

A liquid jet head has a head chip which ejects liquid droplets, a nozzle plate in contact with a lower surface of the head chip, a flexible circuit board in contact with the lower surface of the head chip, and a bending member in direct contact with the flexible circuit board and configured to bend the flexible circuit board along a lower corner of the head chip. The nozzle plate and the flexible circuit board contact the lower surface of the head chip in the same plane thereby saving space to enable downsizing of the liquid jet head.

18 Claims, 7 Drawing Sheets

(56) References Cited

U.S. PATENT DOCUMENTS

2013/0076834 A1 3/2013 Nosaka et al. ..... 347/50

FOREIGN PATENT DOCUMENTS

| | | | |
|---|---|---|---|
| JP | 2007296707 A | * | 11/2007 |
| JP | 2007320075 | | 12/2007 |
| JP | 2012081644 | | 4/2012 |
| JP | 2012116087 | | 6/2012 |

* cited by examiner prior art
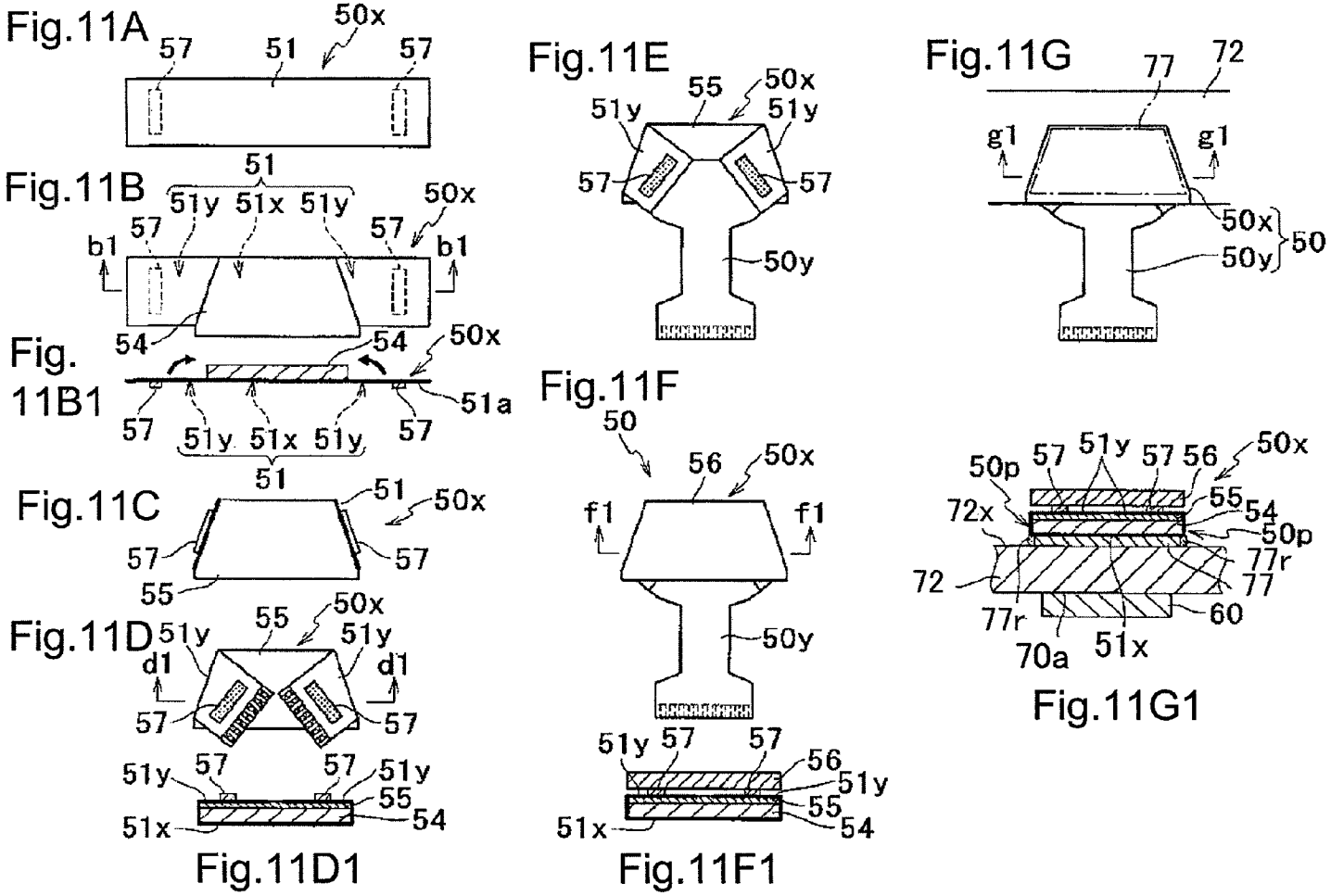

LIQUID JET HEAD AND LIQUID JET APPARATUS

BACKGROUND

Technical Field

The present invention relates to a liquid jet head which jets liquid droplets onto a recording medium to perform recording and a liquid jet apparatus.

Related Art

In recent years, there has been used a liquid jet head of an ink jet system which ejects ink droplets onto, for example, recording paper to record characters or figures thereon, or ejects a liquid material onto the surface of an element substrate to form a functional thin film thereon. In this ink jet system, liquid such as ink and a liquid material is guided from a liquid tank into a channel through a supply tube, and pressure is applied to the liquid filled in the channel to thereby eject the liquid as liquid droplets from a nozzle which communicates with the channel. In the ejection of liquid droplets, characters or figures are recorded, or a functional thin film having a predetermined shape or a three-dimensional structure is formed by moving the liquid jet head or a recording medium.

This type of liquid jet head includes, for example, a head chip in which channels which induce pressure waves in liquid are embedded, a liquid tank which supplies liquid to the head chip, a drive circuit which supplies a drive signal to the head chip, and a flexible printed circuit (FPC) which is located between the drive circuit and the head chip and transmits a drive signal from the drive circuit to the head chip. In recent years, an assembling method in which an FPC is bent and connected to a narrow clearance has been employed along with an increase in the number and the density of channels and an increase in capacity caused by arranging a plurality of head chips together.

FIGS. 11A to 11G1 are diagrams illustrating a method of assembling a wiring module 50 to be connected to an ink jet head (liquid jet head) (JP 2012-116087 A). The ink jet head is provided with eight actuator units 77. The actuator units 77 are arranged in a line on a flow path unit 72. Each of the actuator units 77 includes four heads. A chip on film (COF) 50*x* is placed on each of the actuator units 77. A large number of lands are placed on the upper surface of each of the actuator units 77, and electrically connected to wiring of the COF 50*x* at contacts.

A flexible wiring board which is bent and used in a liquid jet head is described in JP 2006-281736 A and JP 2012-81644 A. JP 2006-281736 A describes a method of connecting a flexible wiring board to the surface of a first plate to which a nozzle plate is adhered, and then bending the flexible wiring board along the end surface of the first plate to adhere the flexible wiring board to the end surface of the first plate. A clearance is previously provided at a corner between the surface and the end surface of the first plate, and filled with an adhesive. Then, the bent flexible wiring board is adhered to the first plate with the adhesive and fixed along the end surface of the first plate. JP 2012-81644 A describes a method of connecting a flexible wiring board whose end part is previously bent to a flow path forming substrate. Wiring is formed on the surface of the bent end part of the flexible wiring board. An anisotropic conductive film (ACF) adhesive is interposed between the wiring and a lead electrode of the flow path forming substrate, and the end part of the flexible wiring board and the flow path forming substrate are connected to each other by thermocompression bonding.

Then, a molding agent is filled into the bent portion of the flexible wiring board and solidified.

SUMMARY

In the wiring module 50 described in JP 2012-116087 A, the magnetic member 54 is placed on the flexible long plate-like base material 51, and the second regions 51*y* of the base material 51 are then bent upward along the outer shape of the magnetic member 54 and adhered to the side end surfaces of the magnetic member 54 with an adhesive near the bent portions. However, since the base material 51 is bent along the outer shape of the magnetic member 54, shift in the bending position is likely to occur due to the elasticity of the base material 51. The occurrence of shift in the bending position makes positioning between the contacts in the second regions 51*y* and the contacts in the FPC 50*y* difficult when the FPC 50*y* is connected to the ends of the second regions 51*y*.

When the flexible wiring board described in JP 2006-281736 A is connected to the first plate, the flexible wiring board in a flat state is first connected to the first plate, and the flexible wiring board is then bent along the end surface of the first plate. Thus, a space sufficient for bending the flexible wiring board from a flat state is required near the end surface of the first plate. When there is no sufficient space near a bending place, the method described in JP 2006-281736 A cannot be employed. Further, JP 2012-81644 A fails to describe means for maintaining the bent shape of the tip part of the flexible wiring board.

A liquid jet head of the present invention is provided with a head chip configured to eject liquid droplets, a flexible circuit board connected to the head chip, and a bending member located on the flexible circuit board, the bending member being configured to bend the flexible circuit board along a corner of the head chip.

The bending member is bent at a position substantially the center of a width in a short side direction.

The bending member extends from an end on one side of the flexible circuit board through an end on the other side thereof.

The bending member is divided into a plurality of bending members and located between an end on one side of the flexible circuit board and an end on the other side thereof.

The bending member includes a region on substantially the center of the width in the short side direction, the region being thinner than the other region.

The bending member includes a metal layer.

The metal layer is a metal plate, and an adhesive layer is interposed between the metal plate and the flexible circuit board.

The metal layer is located on a surface of the flexible circuit board or inside the flexible circuit board.

The metal layer is a layer formed by evaporating, sputtering, or plating a metal material.

The bending member includes a plastic material.

The head chip includes electrode terminals arranged on a surface of the head chip at positions near the corner, and the electrode terminals are electrically connected to the metal layer.

The head chip includes ejection channels configured to eject liquid droplets, and the flexible circuit board includes nozzles communicating with the ejection channels.

The head chip includes ejection channels configured to eject liquid droplets and non-ejection channels configured not to eject liquid droplets, the ejection channels and the non-ejection channels being alternately arrayed with side walls each including a piezoelectric body interposed therebetween, common drive electrodes arranged on wall surfaces of the side walls, the wall surfaces facing the ejection channels, and individual drive electrodes arranged on wall surfaces of the side walls, the wall surfaces facing the non-ejection channels. The head chip includes common electrode terminals electrically connected to the common drive electrodes and individual electrode terminals electrically connected to the individual drive electrodes. The flexible circuit board includes individual wiring lines electrically connected to the individual electrode terminals and common wiring lines electrically connected to the common electrode terminals, the individual wiring lines and the common wiring lines being arranged on a surface of the flexible circuit board, the surface facing the head chip.

A liquid jet apparatus of the present invention is provided with the liquid jet head described above, a movement mechanism configured to relatively move the liquid jet head and a recording medium, a liquid supply tube configured to supply liquid to the liquid jet head, and a liquid tank configured to supply the liquid to the liquid supply tube.

The liquid jet head according to the present invention is provided with the head chip configured to eject liquid droplets, the flexible circuit board connected to the head chip, and the bending member located on the flexible circuit board, the bending member being configured to bend the flexible circuit board along the corner of the head chip. Accordingly, the flexible circuit board in a bent state can be connected to the corner of the head chip, which facilitates positioning between the head chip and the flexible circuit board.

BRIEF DESCRIPTION OF DRAWINGS

FIGS. 11A to 11G1 are diagrams illustrating a method of assembling a wiring module to be connected to a conventionally known liquid jet head.

DETAILED DESCRIPTION

First Embodiment

Figure 1:
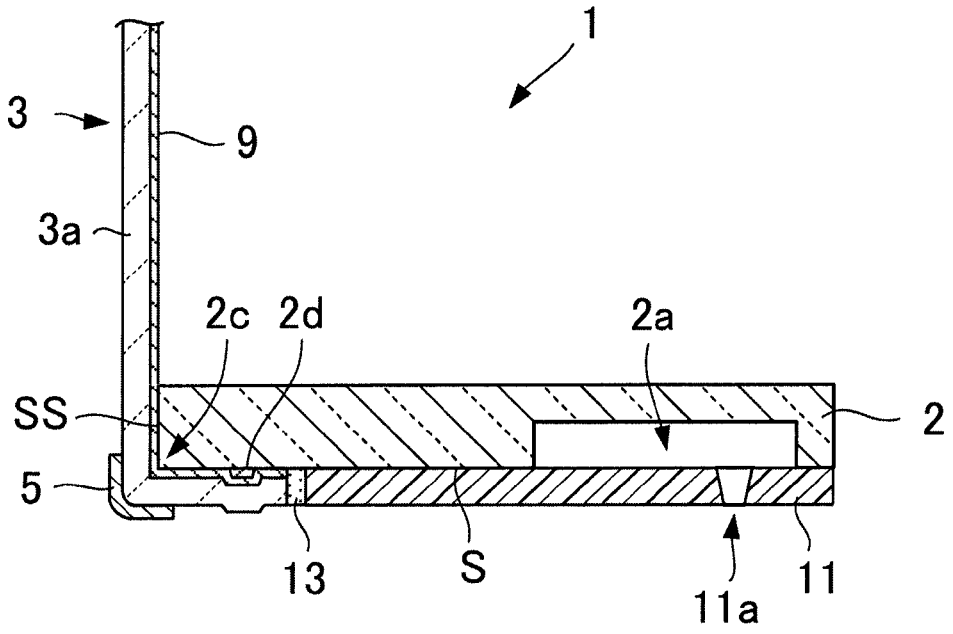
FIG. 1 is a schematic cross-sectional view of a liquid jet head according to a first embodiment of the present invention.

FIG. 1 is a schematic cross-sectional view of a liquid jet head 1 according to a first embodiment of the present invention. The liquid jet head 1 is provided with a head chip 2 which ejects liquid droplets, a flexible circuit board 3 which is connected to the head chip 2, and a bending member 5 which bends the flexible circuit board 3 along a lower corner 2*c* of the head chip 2. The bending member 5 is located on a bent portion of the flexible circuit board 3 which is bent corresponding to the corner 2*c* of the head chip 2 and previously bends the flexible circuit board 3. Accordingly, the flexible circuit board 3 in a bent state can be connected to the corner 2*c* of the head chip 2, which facilitates positioning between the head chip 2 and the flexible circuit board 3. Further, a space for bending the flexible circuit board 3 is not required around the corner 2*c* of the head chip 2. Furthermore, the flexible circuit board 3 can be easily bent at a desired angle.

The head chip 2 may use a piezo system which uses an electrostrictive effect of a piezoelectric substrate as an actuator for ejecting liquid droplets or a bubble system which heats liquid by a heating element to generate air bubbles. A plastic material such as a polyimide film may be used as a substrate 3*a* of the flexible circuit board 3. A plastically deformable member which is plastically deformable in response to an external force or a molded member which is previously molded into a bent shape may be used as the bending member 5. For example, a metal plate as a metal layer adhered with an adhesive, a plastically deformable member such as a metal layer formed by depositing a metal material by, for example, an evaporation method, a sputtering method, or a plating method, or a molded member made of a metal material, an inorganic material, or a plastic material may be used. For example, Cu, Al, or Ni deposited in the thickness of 10 μm to 50 μm may be used as the metal layer. For example, a bent plastic plate may be used as the molded member. Further, one formed by adhering a metal plate to a metal layer formed by depositing a metal material by, for example, an evaporation method, a sputtering method, or a plating method, or a laminate of, for example, a metal layer and a plastic material may be used as the bending member 5.

Specifically, the liquid jet head 1 is provided with the head chip 2 which functions as an actuator and a nozzle plate 11 which is placed on a liquid ejection side surface (lower surface) S of the head chip 2. As illustrated in FIG. 1, the nozzle plate 11 has a contacting surface portion in contact with the lower surface S of the head chip 2, and the contacting surface portion of the nozzle plate is coplanar with a contacting surface portion of the flexible circuit board 3 that is also in contact with the lower surface S of the head chip. That is, the flexible circuit board 3 is connected to the head chip 2 in the plane in which the nozzle plate 11 is placed. The head chip 2 is provided with ejection channels 2*a* which induce pressure waves in liquid filled inside thereof and a large number of electrode terminals 2*d* to which a drive signal for driving the ejection channels 2*a* is supplied. The nozzle plate 11 is provided with nozzles 11*a* which communicate with the respective ejection channels 2*a*. A large number of wiring lines 9 are arrayed in the longitudinal direction of the bending member 5. The wiring lines 9 are electrically connected to the respective electrode terminals 2*d* of the head chip 2. The flexible circuit board 3 is provided with the substrate 3*a* which includes a flexible film and the wiring lines 9 which are located on a surface of the substrate 3*a*, the surface facing the head chip 2, and connected to the liquid ejection side surface S of the head chip 2. The bending member 5 includes a metal plate as a metal layer and located on a corner of the flexible circuit board 3 which is bent corresponding to the corner 2*c* of the head chip 2. An adhesive layer (not illustrated) is interposed between the bending member 5 including a metal plate and the flexible circuit board 3 whereby the bending member is adhered in direct contact with the flexible circuit board. The bending member 5 and the wiring lines 9 are located on the opposite surfaces of the substrate 3*a*.

The flexible circuit board 3 bent by the bending member 5 is connected to the head chip 2. The bending angle of the flexible circuit board 3 is preferably aligned with the angle between the surface S and an end surface SS of the head chip 2, but may not be necessarily aligned therewith. The wiring lines 9 of the flexible circuit board 3 are electrically connected to the respective electrode terminals 2*d* of the head chip 2 with an anisotropic conductive material (not illustrated) interposed therebetween. Bringing the substrate 3*a* of the flexible circuit board 3 into intimate contact with the surface S near the corner 2*c* or the end surface SS of the head chip 2 enables space saving in the liquid jet head 1. However, the substrate 3*a* may not be necessarily in intimate contact with the surface S near the corner 2*c* or the end surface SS. A clearance between an end of the substrate 3*a* and the nozzle plate 11 is filled and sealed with an adhesive 13 to prevent infiltration of liquid. As will be described below, the flexible circuit board 3 may be extended, nozzles which communicate with the respective ejection channels 2*a* may be formed on the extended portion to allow the flexible circuit board 3 to function as a nozzle plate.

Second Embodiment

Figure 2:
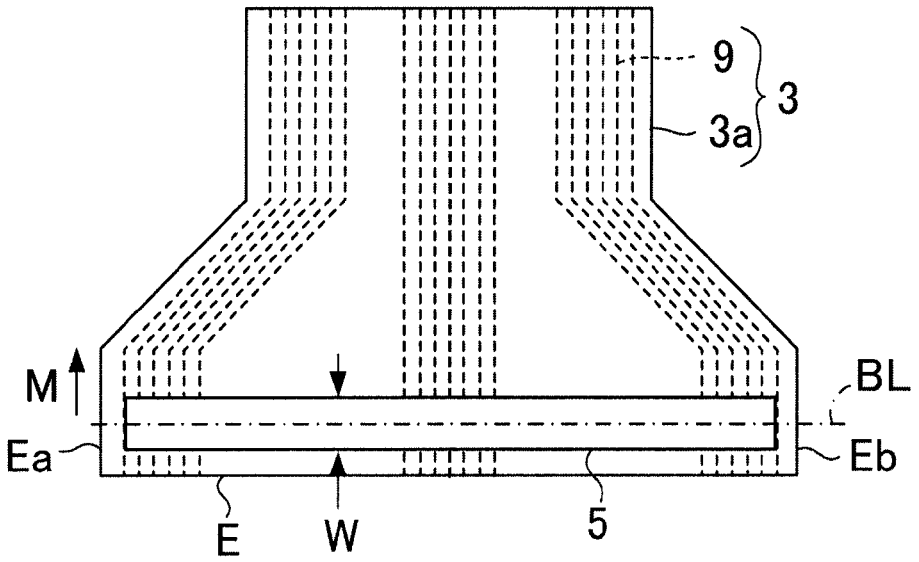
FIG. 2 is a schematic top view of a flexible circuit board used in a liquid jet head according to a second embodiment of the present invention before bending.

FIG. 2 is a schematic top view of a flexible circuit board 3 used in a liquid jet head 1 according to a second embodiment of the present invention before bending. Identical elements or elements having identical functions will be designated by the same reference numerals.

The flexible circuit board 3 is provided with a substrate 3*a* which includes a flexible film and wiring lines 9 which are located on a surface of the substrate 3*a*. A bending member 5 is located on one surface (hereinbelow, also referred to as a first surface) of the substrate 3*a* along an end E corresponding to electrode terminals 2*d* of a head chip 2, and the wiring lines 9 are located on the other surface (hereinbelow, also referred to as a second surface) of the substrate 3*a*. The bending member 5 includes a metal plate and has a rectangular shape in plan view before bending. The bending member 5 extends from a position on the inner side of an end Ea on one side of the substrate 3*a* of the flexible circuit board 3 through a position on the inner side of an end Eb on the other side thereof. The bending member 5 is bent at a position of a bending line BL located on substantially the center of a width W in a short side direction M thereof. The bending angle is preferably aligned with the angle between the surface S and the end surface SS of the head chip 2 (refer to FIG. 1). In addition to the metal plate as a metal layer, a plastically deformable member such as a metal layer formed by depositing a metal material by, for example, an evaporation method, a sputtering method, or a plating method, or a molded member such as a molded plastic material may be used as the bending member 5. Further, one formed by adhering a metal plate to a metal layer formed by depositing a metal material by, for example, an evaporation method, a sputtering method, or a plating method, or a laminate of, for example, a metal layer and a plastic material may be used as the bending member 5.

Accordingly, the flexible circuit board 3 in a bent state can be connected to the corner 2*c* of the head chip 2, which facilitates positioning between the head chip 2 and the flexible circuit board 3. Further, a space for bending the flexible circuit board 3 is not required around the corner 2*c* of the head chip 2.

Third Embodiment

Figure 3:
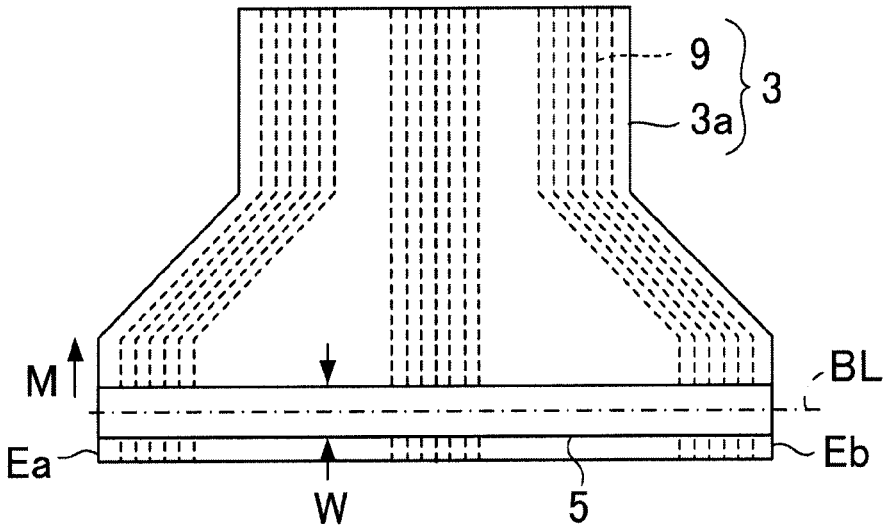
FIG. 3 is a schematic top view of a flexible circuit board used in a liquid jet head according to a third embodiment of the present invention before bending.

FIG. 3 is a schematic top view of a flexible circuit board 3 used in a liquid jet head 1 according to a third embodiment of the present invention before bending. The third embodiment differs from the second embodiment in that a bending member 5 extends from an end Ea on one side of a substrate 3*a* of the flexible circuit board 3 up to an end Eb on the other side thereof. The other configurations are similar to those of the second embodiment. Identical elements or elements having identical functions will be designated by the same reference numerals.

As illustrated in FIG. 3, the bending member 5 extends from the end Ea on one side of the substrate 3*a* of the flexible circuit board 3 through the end Eb on the other side thereof. The bending member 5 is bent at a position of a bending line BL located on substantially the center of a width W in a short side direction M of the bending member 5. The bending line BL corresponds to a corner 2*c* of a head chip 2 (not illustrated). Accordingly, it is possible to uniformly bend the flexible circuit board 3 from the end Ea on one side through the end Eb on the other side and thereby uniformly connect the flexible circuit board 3 to the head chip 2. The materials of the substrate 3*a* of the flexible circuit board 3 and the bending member 5 are similar to those of the first embodiment. Thus, description thereof will be omitted.

Fourth Embodiment

Figure 4:
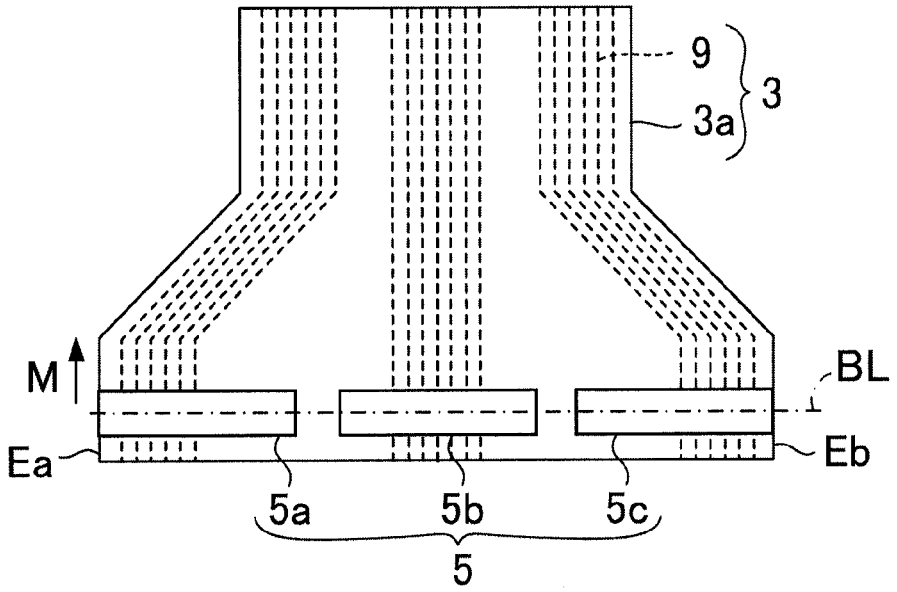
FIG. 4 is a schematic top view of a flexible circuit board used in a liquid jet head according to a fourth embodiment of the present invention before bending.

FIG. 4 is a schematic top view of a flexible circuit board 3 used in a liquid jet head 1 according to a fourth embodiment of the present invention before bending. The fourth embodiment differs from the third embodiment in that a bending member 5 is divided into a plurality of members and located on the flexible circuit board 3. The other configurations are similar to those of the third embodiment. Identical elements or elements having identical functions will be designated by the same reference numerals.

As illustrated in FIG. 4, three bending members 5*a*, 5*b*, and 5*c* are linearly arrayed apart from each other along a bending line BL between an end Ea on one side and an end Eb on the other side on a first surface of a substrate 3*a* of the flexible circuit board 3. Each of the bending members 5*a*, 5*b*, and 5*c* is bent at a position of the bending line BL located on substantially the center of a width in a short side direction M. The substrate 3*a* is provided with a large number of wiring lines 9 located on a second surface thereof. The wiring lines 9 are arrayed in the longitudinal direction of the bending member 5 and electrically connected to a large number of electrode terminals 25 of a head chip 2 (not illustrated). The materials of the substrate 3*a* of the flexible circuit board 3 and the bending member 5 are similar to those of the first embodiment. Thus, description thereof will be omitted.

Since the bending member 5 is divided into the bending members 5*a*, 5*b*, and 5*c* which are arrayed apart from each other on the flexible circuit board 3 in this manner, even when the linear expansion coefficient of the bending member 5 differs from the linear expansion coefficient of the substrate 3*a* of the flexible circuit board 3, expansion or contraction of the flexible circuit board 3 caused by a difference in thermal expansion is dispersed. Thus, it is possible to reduce position shift between the wiring lines 9 and the electrode terminals caused when the flexible circuit board 3 is thermocompression bonded to the head chip 2.

Fifth Embodiment

Figure 5A:
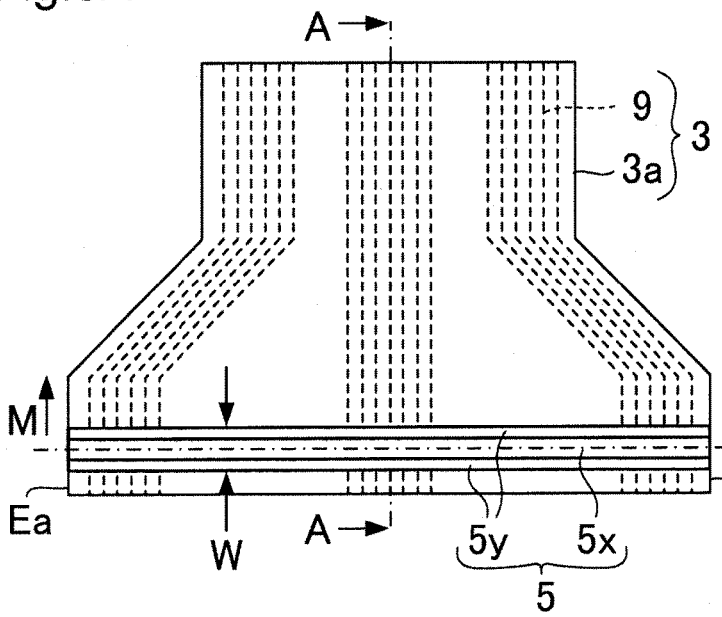
FIGS. 5A and 5B are explanatory diagrams of a flexible circuit board used in a liquid jet head according to a fifth embodiment of the present invention before bending.
Figure 5B:
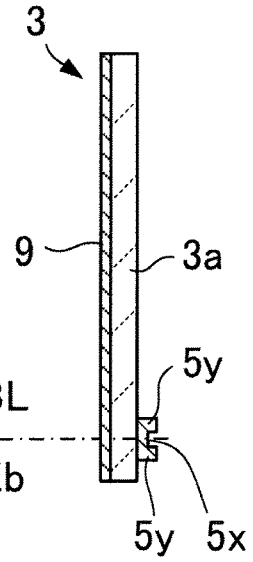

FIGS. 5A and 5B are explanatory diagrams of a flexible circuit board 3 used in a liquid jet head 1 according to a fifth embodiment of the present invention before bending. The fifth embodiment differs from the third embodiment in that a thin region is formed on a bending member 5 in a short side direction M of the bending member 5. The other configurations are similar to those of the third embodiment. Identical elements or elements having identical functions will be designated by the same reference numerals.

FIG. 5A is a schematic top view of the flexible circuit board 3 before bending. FIG. 5B is a schematic cross-sectional view taken along line A-A. As illustrated in FIGS. 5A and 5B, a substrate 3*a* of the flexible circuit board 3 is provided with a large number of wiring lines 9 located on a second surface connected to a head chip 2. The bending member 5 extends from an end Ea on one side of the substrate 3*a* of the flexible circuit board 3 thorough an end Eb on the other side thereof. The bending member 5 includes a bending member 5*x* located in a substantially central region of a width W in a short side direction M and bending members 5*y* in the other region, wherein the bending member 5*x* is thinner than the bending members 5*y*. That is, the bending member 5 includes a thin groove which is formed on a surface opposite to the substrate 3*a* at a position substantially the center of the width W in the short side direction M. Accordingly, the bending member 5 can be easily and linearly bent along the groove, that is, the bending member 5*x* before or after placement of the bending member 5 on the flexible circuit board 3. A metal plate may be used as the bending member 5, and placed on the flexible circuit board 3 with an adhesive layer interposed therebetween. Alternatively, a metal layer may be used as the bending member 5, and may be deposited on the substrate 3*a* by, for example, a sputtering method, an evaporation method, or a plating method. As with the fourth embodiment, a plurality of bending members 5 may be placed on the substrate 3*a* between the end Ea on one side and the end Eb on the other side. The materials of the substrate 3*a* of the flexible circuit board 3 and the bending member 5 are similar to those of the first embodiment. Thus, description thereof will be omitted.

Sixth Embodiment

Figure 6:
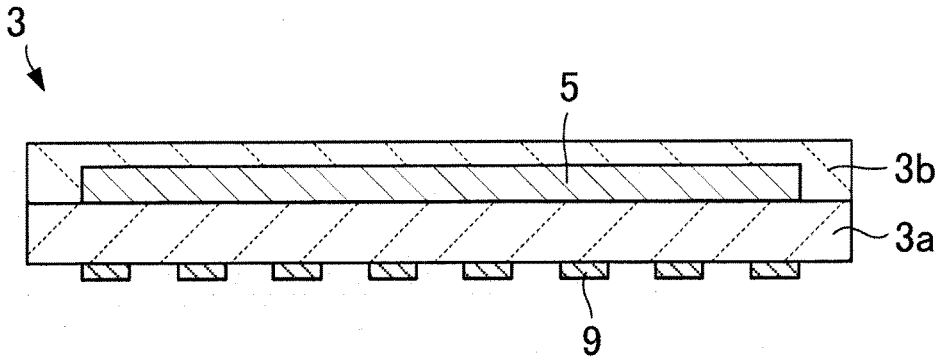
FIG. 6 is a schematic cross-sectional view of a bending member of a flexible circuit board used in a liquid jet head according to a sixth embodiment of the present invention along the longitudinal direction.

FIG. 6 is a schematic cross-sectional view of a bending member 5 of a flexible circuit board 3 used in a liquid jet head 1 according to a sixth embodiment of the present invention along the longitudinal direction. The sixth embodiment differs from the other embodiments in that the bending member 5 is embedded inside the flexible circuit board 3. Identical elements or elements having identical functions will be designated by the same reference numerals.

As illustrated in FIG. 6, the flexible circuit board 3 is provided with a substrate 3*a* which is made of a plastic material such as polyimide, a substrate 3*b* which is made of a plastic material such as polyimide and functions as a protective film, and a plurality of wiring lines 9 which are located on a second surface of the substrate 3*a*. The bending member 5 includes a metal layer and located at a bent portion of the flexible circuit board 3 which is bent corresponding to a corner 2*c* of a head chip 2 (not illustrated) between the substrate 3*a* and the substrate 3*b*. That is, the bending member 5 is located inside the substrates of the flexible circuit board 3. The bending member 5 can be used as electrode wiring for supplying a drive signal to the head chip 2 (not illustrated). The metal layer may be formed by depositing a metal material on the substrate 3*a* by, for example, an evaporation method, a sputtering method, or a plating method. In addition to placing the metal layer inside the flexible circuit board 3, the metal layer may be placed on the surface of the flexible circuit board 3 as in the first to fifth embodiments as the bending member 5. The materials of the substrate 3*a* of the flexible circuit board 3 and the bending member 5 are similar to those of the first embodiment. Thus, description thereof will be omitted.

Seventh Embodiment

Figure 7A:
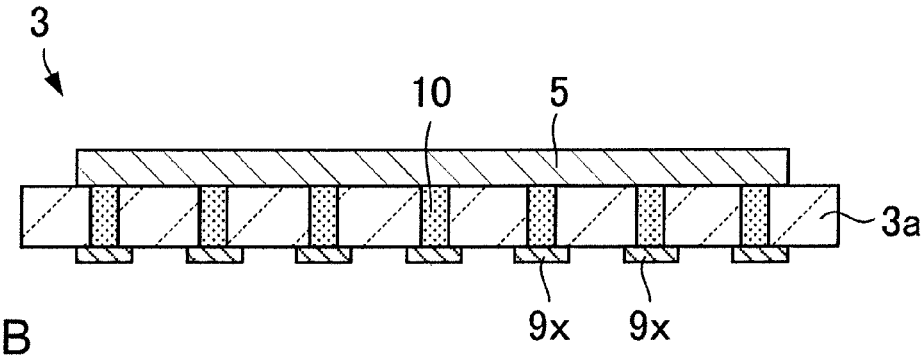
FIGS. 7A and 7B are schematic cross-sectional views of a flexible circuit board used in a liquid jet head according to a seventh embodiment of the present invention.
Figure 7B:
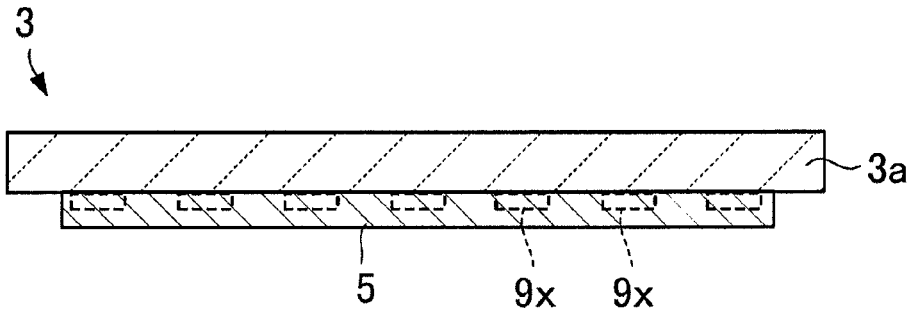

FIGS. 7A and 7B are schematic cross-sectional views of a flexible circuit board 3 used in a liquid jet head 1 according to a seventh embodiment of the present invention. FIG. 7A is a schematic cross-sectional view of a bending member 5 placed on a first surface of a substrate 3*a* of the flexible circuit board 3. FIG. 7B is a schematic cross-sectional view of a bending member 5 placed on a second surface of the substrate 3*a* of the flexible circuit board 3. Identical elements or elements having identical functions will be designated by the same reference numerals.

As illustrated in FIG. 7A, the flexible circuit board 3 is provided with the substrate 3*a* and a plurality of wiring terminals 9*x*. The wiring terminals 9*x* are located on the second surface of the substrate 3*a*, the second surface being connected to a head chip 2 (not illustrated). The bending member 5 is located on the first surface of the substrate 3*a*, the first surface being opposite to the second surface, at a position corresponding to a corner 2*c* of the head chip 2 (not illustrated). The bending member 5 has conductivity. The bending member 5 includes, for example, a metal plate or a metal layer formed by depositing a metal material by, for example, an evaporation method, a sputtering method, or a plating method. The flexible circuit board 3 is further provided with a plurality of through electrodes 10 which penetrate the substrate 3*a* from the first surface through the second surface. Each of the through electrodes 10 electrically connects the corresponding wiring terminal 9*x* to the bending member 5. In this manner, the bending member 5 electrically connects the wiring terminals 9*x* which are separated from each other. The bending member 5 can be formed to have a small wiring resistance, and thus can be used as a common electrode of the head chip 2.

FIG. 7A illustrates only the wiring terminals 9*x* as objects to be commonalized. However, individual terminals which are not commonalized may be disposed on the substrate 3*a*. In this case, the individual terminals may be arranged in a manner to prevent an electrical short circuit between the individual terminals and the wiring terminals 9*x* and the individual terminals and the bending member 5.

As illustrated in FIG. 7B, the flexible circuit board 3 is provided with the substrate 3*a* and a plurality of wiring terminals 9*x*. The wiring terminals 9*x* are located on a second surface of the substrate 3*a*, the second surface being connected to a head chip 2 (not illustrated). The bending member 5 is located on the second surface of the substrate 3*a* at a position corresponding to a corner 2*c* of the head chip 2 (not illustrated). The bending member 5 is a conductor including, for example, a metal plate or a metal layer, and electrically connected to each of the wiring terminals 9*x*. In this manner, the bending member 5 electrically connects the wiring terminals 9*x* which are electrically separated from each other to form a common electrode. The bending member 5 can be formed to have a small wiring resistance, and thus can be used as a common electrode of the head chip 2. An insulating layer may be interposed between the wiring terminals 9*x* and the bending member 5 to electrically separate the bending member 5 from each of the wiring terminals 9*x*. In this case, an insulating material, for example, a plastic material may be used as the bending member 5.

As with the case of FIG. 7A, individual terminals which are not commonalized may be disposed on the substrate 3*a* also in FIG. 7B. For example, in this case, the individual terminals may be placed on the second surface of the substrate 3*a*. The materials of the substrate 3*a* of the flexible circuit board 3 and the bending member 5 are similar to those of the first embodiment. Thus, description thereof will be omitted.

Eighth Embodiment

Figure 8:
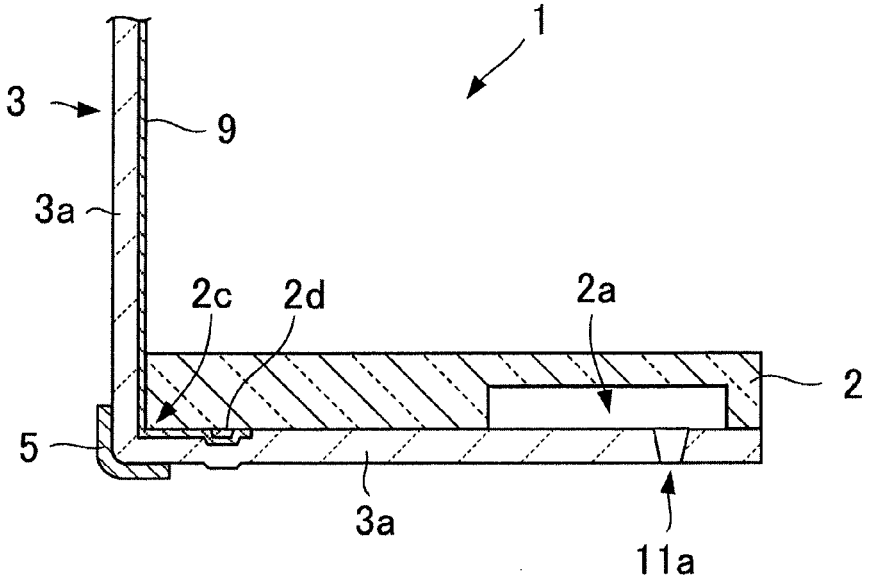
FIG. 8 is a schematic cross-sectional view of a liquid jet head according to an eighth embodiment of the present invention.

FIG. 8 is a schematic cross-sectional view of a liquid jet head 1 according to an eighth embodiment of the present invention. The eighth embodiment differs from the first embodiment in that a flexible circuit board 3 also functions as a nozzle plate. The other configurations are similar to those of the first embodiment. Identical elements or elements having identical functions will be designated by the same reference numerals.

As illustrated in FIG. 8, the liquid jet head 1 is provided with a head chip 2 which ejects liquid droplets, the flexible circuit board 3 which is connected to the head chip 2, and a bending member 5 which bends the flexible circuit board 3 along a corner 2*c* of the head chip 2. The bending member 5 is located on a bent portion of a substrate 3*a* which is bent corresponding to the corner 2*c* of the head chip 2 and previously bends the substrate 3*a*. The head chip 2 is provided with ejection channels 2*a* which induce pressure waves in liquid filled inside thereof and electrode terminals 2*d* which are located on a liquid ejection side surface thereof. The flexible circuit board 3 is provided with the substrate 3*a*, wiring lines 9 which are located on a surface of the substrate 3*a*, the surface facing the head chip 2, and electrically connected to the respective electrode terminals 2*d*, and nozzles 11*a* which communicate with the respective ejection channels 2*a*. The bending member 5 is located on a surface of the substrate 3*a*, the surface being opposite to the head chip 2, at a position corresponding to the corner 2*c* of the head chip 2. The materials of the substrate 3*a* of the flexible circuit board 3 and the bending member 5 are similar to those of the first embodiment.

The flexible circuit board 3 also functions as a nozzle plate in this manner so that the flexible circuit board 3 and the nozzle plate are formed as one member. This configuration reduces the number of components of the liquid jet head 1 and reduces the manufacturing steps. Further, the flexible circuit board 3 in a bent state can be connected to the corner 2*c* of the head chip 2, which facilitates positioning between the head chip 2 and the flexible circuit board 3. Further, a space for bending the flexible circuit board 3 is not required around the corner 2*c* of the head chip 2. Furthermore, the flexible circuit board 3 can be easily bent at a desired angle.

Ninth Embodiment

Figure 9:
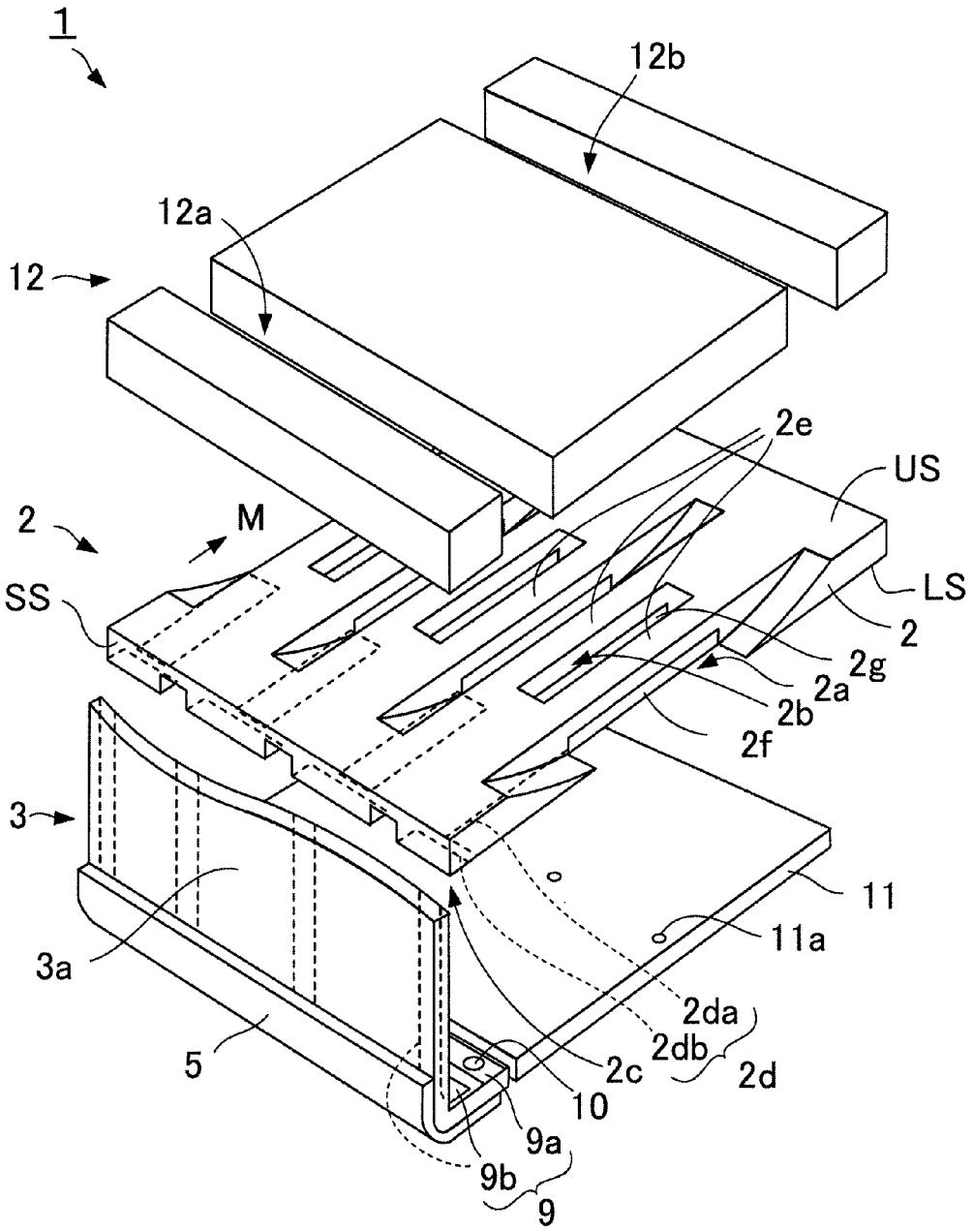
FIG. 9 is a schematic exploded perspective view of a liquid jet head according to a ninth embodiment of the present invention.

FIG. 9 is a schematic exploded perspective view of a liquid jet head 1 according to a ninth embodiment of the present invention. The liquid jet head 1 of the present embodiment is a side shoot type liquid jet head employing a piezo system. Identical elements or elements having identical functions will be designated by the same reference numerals.

As illustrated in FIG. 9, the liquid jet head 1 is provided with a head chip 2 which ejects liquid droplets, a flexible circuit board 3 which is connected to the head chip 2, and a bending member 5 which bends the flexible circuit board 3 along a corner 2*c* of the head chip 2. The bending member 5 is located on a bent portion of substrate 3*a* of the flexible circuit board 3 which is bent corresponding to the corner 2*c* of the head chip 2 and previously bends the substrate 3*a*. The head chip 2 includes ejection channels 2*a* into which liquid flows and non-ejection channels 2*b* into which no liquid flows. The ejection channels 2*a* and the non-ejection channels 2*b* are alternately arrayed with side walls 2*e* each including a piezoelectric body interposed therebetween. Common drive electrodes 2*f* are disposed on wall surfaces of the side walls 2*e*, the wall surfaces facing the ejection channels 2*a*. Individual drive electrodes 2*g* are disposed on wall surfaces of the side walls 2*e*, the wall surfaces facing the non-ejection channels 2*b*.

The head chip 2 is provided with electrode terminals 2*d* which are located on a surface (lower surface LS) thereof at positions near the corner 2*c*. The electrode terminals 2*d* include common electrode terminals 2*da* which are electrically connected to the common drive electrodes 2*f* and individual electrode terminals 2*db* which are electrically connected to the individual drive electrodes 2*g*. The flexible circuit board 3 is provided with the substrate 3*a* which includes a flexible film, individual wiring lines 9*b* which are electrically connected to the individual electrode terminals 2*db*, and common wiring lines 9*a* which are electrically connected to the common electrode terminals 2*da*. The common wiring lines 9*a* and the individual wiring lines 9*b* are arranged on a surface of the substrate 3*a*, the surface facing the head chip 2. Ends of the common wiring lines 9*a* and the individual wiring lines 9*b* function as wiring terminals.

The bending member 5 is located on a surface of the substrate 3*a* of the flexible circuit board 3, the surface being opposite to the head chip 2, at a position corresponding to the corner 2*c* of the head, chip 2. The bending member 5 includes a metal layer and electrically connected to the common wiring lines 9*a* through electrodes 10 which penetrate the substrate 3*a*. That is, the bending member 5 functions as an electrode which transmits a drive signal for driving the head chip 2.

The liquid jet head 1 is further provided with a cover plate 12 which is located on a surface (upper surface US) of the head chip 2 and a nozzle plate 11 which is located on the surface (lower surface LS) of the head chip 2. The cover plate 12 is provided with a liquid chamber 12*a* which communicates with one end of each of the ejection channels 2*a* and a liquid chamber 12*b* which communicates with the other end of each of the ejection channels 2*a*. The nozzle plate 11 is provided with nozzles 11*a* which communicate with the respective ejection channels 2*a*.

Placing the bending member 5 which bends the flexible circuit board 3 at the position corresponding to the corner 2*c* of the head chip 2 on the flexible circuit board 3 makes it possible to easily perform positioning between the electrode terminals 2*d* on the surface (lower surface LS) of the head chip 2 and the wiring lines 9 on the flexible circuit board 3 in a bent state. Further, it is possible to easily thermocompression bond the flexible circuit board 3 and the head chip 2 to each other by pressing a crimp terminal against the flexible circuit board 3 in a bent state from the lower side. Thus, a space for bending the flexible circuit board 3 is not required around the corner 2*c* of the head chip 2.

The liquid jet head 1 operates in the following manner. Liquid is supplied from a liquid tank (not illustrated) to the liquid chamber 12*a* or 12*b* of the cover plate 12. The liquid flows into the ejection channels 2*a*, and flows out to the liquid tank through the liquid chamber 12*a* or 12*b*. Then, a drive signal is applied between the common wiring lines 9*a* and the individual wiring lines 9*b*. Accordingly, the drive signal is transmitted to the common drive electrodes 2*f* and the individual drive electrodes 2*g* of the opposite side walls 2*e* of each of the ejection channels 2*a*, and the opposite side walls 2*e* are thereby deformed. First, the volume of each of the ejection channels 2*a* is increased to draw liquid from the liquid chamber 12*a* or 12*b*. Then, the opposite side walls 2*e* return to the state before deformation to thereby induce a pressure wave in liquid inside each of the ejection channels 2*a*. The pressure wave reaches the corresponding nozzle 11*a* to thereby eject liquid droplets. The liquid jet head 1 of the present invention is not limited to the configuration in which the ejection channels 2*a* and the non-ejection channels 2*b* are alternately arrayed, and may be one in which only the ejection channels 2*a* are arrayed or may be an edge shoot type liquid jet head 1.

Tenth Embodiment

Figure 10:
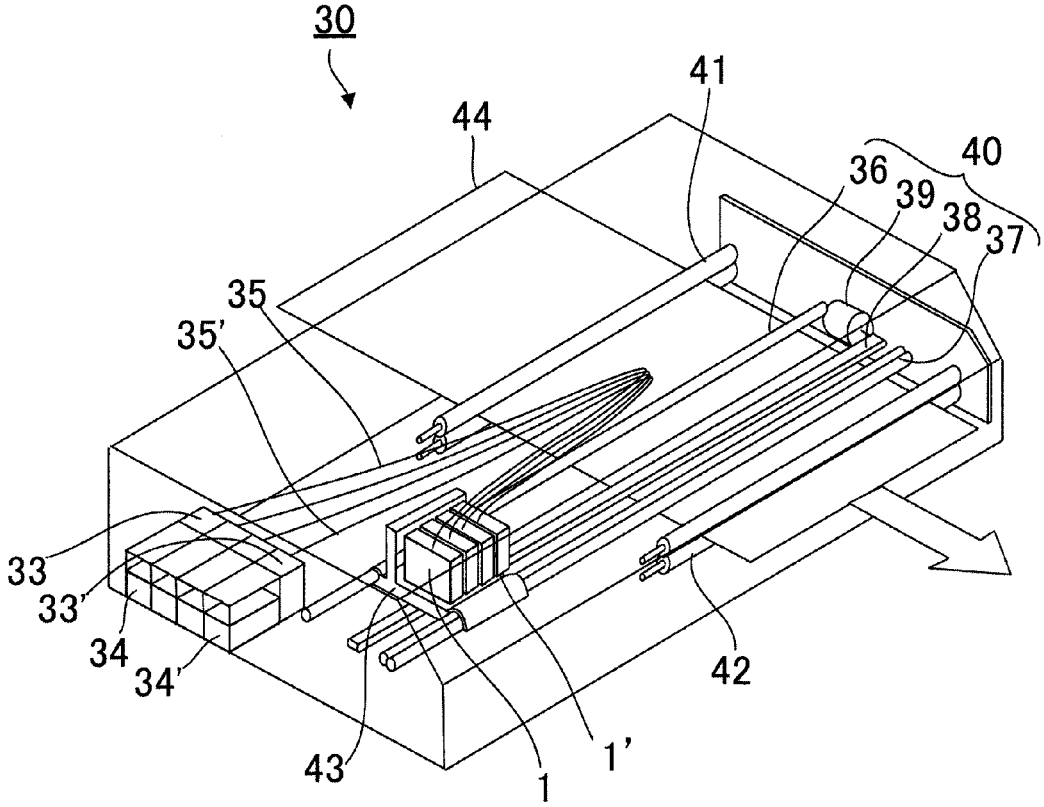
FIG. 10 is a schematic perspective view of a liquid jet apparatus according to a tenth embodiment of the present invention.

FIG. 10 is a schematic perspective view of a liquid jet apparatus 30 according to a tenth embodiment of the present invention. The liquid jet apparatus 30 is provided with a movement mechanism 40 which reciprocates liquid jet heads 1, 1', flow path portions 35, 35' which supply liquid to the liquid jet heads 1, 1' and discharge liquid from the liquid jet heads 1, 1', and liquid pumps 33, 33' and liquid tanks 34, 34' which communicate with the flow path portions 35, 35'. As the liquid pumps 33, 33', either or both of supply pumps which supply liquid to the flow path portions 35, 35' and discharge pumps which discharge liquid to components other than the flow path portions 35, 35' may be provided to circulate liquid. Further, a pressure sensor or a flow sensor (not illustrated) may be provided to control the flow rate of liquid. As each of the liquid jet heads 1, 1', the liquid jet head 1 of each of the first to ninth embodiments may be used.

The liquid jet apparatus 30 is provided with a pair of conveyance units 41, 42 which conveys a recording medium 44 such as paper in a main scanning direction, the liquid jet heads 1, 1' each of which jets liquid onto the recording medium 44, a carriage unit 43 on which the liquid jet heads 1, 1' are placed, the liquid pumps 33, 33' which supply liquid stored in the liquid tanks 34, 34' to the flow path portions 35, 35' by pressing, and the movement mechanism 40 which moves the liquid jet heads 1, 1' in a sub-scanning direction that is perpendicular to the main scanning direction. A control unit (not illustrated) controls the liquid jet heads 1, 1', the movement mechanism 40, and the conveyance units 41, 42 to drive.

Each of the conveyance units 41, 42 extends in the sub-scanning direction, and includes a grid roller and a pinch roller which rotate with the roller surfaces thereof while making contact with each other. The grid roller and the pinch roller are rotated around the respective shafts by a motor (not illustrated) to thereby convey the recording medium 44 which is sandwiched between the rollers in the main scanning direction. The movement mechanism 40 is provided with a pair of guide rails 36, 37 each of which extends in the sub-scanning direction, the carriage unit 43 which is slidable along the pair of guide rails 36, 37, an endless belt 38 to which the carriage unit 43 is coupled to move the carriage unit 43 in the sub-scanning direction, and a motor 39 which revolves the endless belt 38 through a pulley (not illustrated).

The plurality of liquid jet heads 1, 1' are placed on the carriage unit 43. The liquid jet heads 1, 1' eject, for example, four colors of liquid droplets: yellow, magenta, cyan, and black. Each of the liquid tanks 34, 34' stores therein liquid of the corresponding color, and supplies the stored liquid to each of the liquid jet heads 1, 1' through each of the liquid pumps 33, 33' and each of the flow path portions 35, 35'. Each of the liquid jet heads 1, 1' jets liquid droplets of the corresponding color in response to a drive signal. Any patterns can be recorded on the recording medium 44 by controlling the timing of jetting liquid from the liquid jet heads 1, 1', the rotation of the motor 39 which drives the carriage unit 43, and the conveyance speed of the recording medium 44.

In the liquid jet apparatus 30 of the present embodiment, the movement mechanism 40 moves the carriage unit 43 and the recording medium 44 to perform recording. However, instead of this, the liquid jet apparatus may have a configuration in which a carriage unit is fixed, and a movement mechanism two-dimensionally moves a recording medium to perform recording. That is, the movement mechanism may have any configuration as long as it relatively moves the liquid jet head and a recording medium.

What is claimed is:

1. A liquid jet head comprising:

a head chip configured to eject liquid droplets;

a nozzle plate placed on a liquid ejection side of the head chip;

a flexible circuit board connected to the head chip in a plane in which the nozzle plate is placed; and a bending member adhered in direct contact with the flexible circuit board, the bending member being configured to bend the flexible circuit board along a corner of the head chip.

2. The liquid jet head according to claim 1, wherein the bending member is bent at a position substantially the center of a width in a short side direction.

3. The liquid jet head according to claim 1, wherein the bending member extends from an end on one side of the flexible circuit board through an end on the other side thereof.

4. The liquid jet head according to claim 1, wherein the bending member is divided into a plurality of bending members and located between an end on one side of the flexible circuit board and an end on the other side thereof.

5. The liquid jet head according to claim 1, wherein the bending member includes a region on substantially the center of the width in the short side direction, the region being thinner than the other region.

6. The liquid jet head according to claim 1, wherein the bending member includes a metal layer.

7. The liquid jet head according to claim 6, wherein the metal layer is a metal plate, and an adhesive layer is interposed between the metal plate and the flexible circuit board.

8. The liquid jet head according to claim 6, wherein the metal layer is located on a surface of the flexible circuit board or embedded inside the flexible circuit board.

9. The liquid jet head according to claim 6, wherein the metal layer is a layer formed by evaporating, sputtering, or plating a metal material.

10. The liquid jet head according to claim 1, wherein the bending member includes a plastic material.

11. The liquid jet head according to claim 6, wherein the head chip includes electrode terminals arranged on a surface of the head chip at positions near the corner, and the electrode terminals are electrically connected to the metal layer.

12. The liquid jet head according to claim 1, wherein the head chip includes ejection channels configured to eject liquid droplets, and the flexible circuit board and the nozzle plate are formed as one member having nozzles communicating with the ejection channels.

13. The liquid jet head according to claim 1, wherein the head chip includes ejection channels configured to eject liquid droplets and non-ejection channels configured not to eject liquid droplets, the ejection channels and the non-ejection channels being alternately arrayed with side walls each including a piezoelectric body interposed therebetween, common drive electrodes arranged on wall surfaces of the side walls, the wall surfaces facing the ejection channels, and individual drive electrodes arranged on wall surfaces of the side walls, the wall surfaces facing the non-ejection channels, the head chip includes common electrode terminals electrically connected to the common drive electrodes and individual electrode terminals electrically connected to the individual drive electrodes, and the flexible circuit board includes individual wiring lines electrically connected to the individual electrode terminals and common wiring lines electrically connected to the common electrode terminals, the individual wiring lines and the common wiring lines being arranged on a surface of the flexible circuit board, the surface facing the head chip.

14. A liquid jet apparatus comprising:

the liquid jet head according to claim 1;

a movement mechanism configured to relatively move the liquid jet head and a recording medium;

a liquid supply tube configured to supply liquid to the liquid jet head; and a liquid tank configured to supply the liquid to the liquid supply tube.

15. A liquid jet head comprising:

a head chip having upper and lower surfaces and configured to eject liquid droplets;

a nozzle plate having a contacting surface portion in contact with the lower surface of the head chip;

a flexible circuit board having a contacting surface portion in contact with the lower surface of the head chip and coplanar with the contacting surface portion of the nozzle plate; and a bending member adhered in direct contact with the flexible circuit board and configured to bend the flexible circuit board along a lower corner of the head chip.

16. A liquid jet head according to claim 15; wherein the nozzle plate and the flexible circuit board are spaced from one another beneath the lower surface of the head chip, and an adhesive fills and seals the space between the nozzle plate and the flexible circuit board.

17. The liquid jet head according to claim 15, wherein the bending member includes a metal layer.

18. The liquid jet head according to claim 17, wherein the metal layer is located on a surface of the flexible circuit board or embedded inside the flexible circuit board.

* * * * *